US012364900B2

(12) United States Patent
Wallander

(10) Patent No.: US 12,364,900 B2
(45) **Date of Patent: *Jul. 22, 2025**

(54) EXERCISE BAR

(71) Applicant: John Wallander, Riva, MD (US)

(72) Inventor: John Wallander, Riva, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/750,967

(22) Filed: May 23, 2022

(65) Prior Publication Data

US 2022/0280832 A1 Sep. 8, 2022

Related U.S. Application Data

(63) Continuation of application No. 16/695,055, filed on Nov. 25, 2019, now Pat. No. 11,338,170, which is a (Continued)

(51) Int. Cl.
*A63B 21/00* (2006.01)
*A63B 21/055* (2006.01)

(Continued)

(52) U.S. Cl.
CPC .... *A63B 21/4035* (2015.10); *A63B 21/00061* (2013.01); *A63B 21/055* (2013.01); *A63B 21/0724* (2013.01); *A63B 23/12* (2013.01)

(58) Field of Classification Search
CPC ..... A63B 21/02; A63B 21/04; A63B 21/0407; A63B 21/0428; A63B 21/0442;

(Continued)

(56) References Cited

U.S. PATENT DOCUMENTS 4,059,265 A * 11/1977 Wieder ..... A63B 21/0552 482/125
4,326,708 A * 4/1982 Hinds ..... A63B 21/0552 482/123

(Continued)

*Primary Examiner* — Joshua Lee
(74) *Attorney, Agent, or Firm* — Woods Rogers Vandeventer Black PLC; Nathan A. Evans

(57) ABSTRACT

A portable exercise device for use in resistance training programs is provided, which can comprise: a hollow structure; multiple resistance bands, each shorter than the hollow structure; multiple anchor members for securing the resistance bands to the hollow structure; multiple attachable and detachable handles; wherein one end of each resistance band is coupled to an anchor; wherein an opposing end of each resistance band is operably configured for attachment to a handle; such that each resistance band is contained completely within the hollow structure during rest and is capable of extending outside the hollow structure during use when attached to a handle. Such devices can be used by attaching a handle to a resistance band at each end of the hollow bar, gripping the bar with hands, placing feet in the handles, and moving the bar away from the feet to create resistance in the bands thereby exercising the user's body. Such devices can also be used by attaching a handle to the resistance band at each end of the hollow bar, whereby the handle is three-sided and each side serves a different adapted function; for example, one side may be configured for gripping by a user's hand, one side may be configured for engaging by the user's foot, and one side may be configured to anchor to an anchoring structure.

2 Claims, 7 Drawing Sheets

Related U.S. Application Data continuation of application No. 14/951,386, filed on Nov. 24, 2015, now Pat. No. 10,486,013.

(60) Provisional application No. 62/083,604, filed on Nov. 24, 2014.

(51) Int. Cl.
*A63B 21/072* (2006.01)
*A63B 23/12* (2006.01)

(58) Field of Classification Search
CPC ..... A63B 21/055; A63B 21/0552; A63B 21/0555; A63B 21/0557
See application file for complete search history.

(56) References Cited

U.S. PATENT DOCUMENTS 5,131,650 A * 7/1992 Hall ..... A63B 21/0552 482/904
5,484,368 A * 1/1996 Chang ..... A63B 21/0004 482/125
5,531,657 A * 7/1996 Macedo ..... A63B 23/03516 482/106
5,746,687 A * 5/1998 Vial ..... A63B 21/0552 482/125
5,885,196 A * 3/1999 Gvoich ..... A63B 21/00185 482/125
6,402,668 B1 * 6/2002 Harker ..... A63B 21/0552 482/121
6,770,014 B2 * 8/2004 Amore ..... A63B 21/00069 482/121
7,326,157 B2 * 2/2008 Wu ..... A63B 21/0552 482/121
7,578,775 B2 * 8/2009 Terry ..... A63B 21/4009 482/121
7,846,078 B1 * 12/2010 Park ..... A63B 23/03525 482/121
7,918,773 B2 * 4/2011 Brennan ..... A63B 23/03525 482/130
7,922,634 B1 * 4/2011 Wu ..... A63B 23/1263 482/121
8,317,667 B1 * 11/2012 Thomas ..... A63B 21/0421 482/121
8,562,494 B2 * 10/2013 Thomas ..... A63B 21/00043 482/121
8,845,499 B1 * 9/2014 Boatwright ..... A63B 24/0062 482/116
9,126,075 B2 * 9/2015 Tomaszewski .... A63B 21/0724
9,713,734 B1 * 7/2017 Hurlbut ..... A63B 21/05
2008/0081747 A1 * 4/2008 Mok ..... A63B 21/0004 482/121
2008/0280738 A1 * 11/2008 Brennan ..... A63B 21/4035 482/129
2012/0094812 A1 * 4/2012 Smiley ..... A63B 21/05 482/128
2016/0038781 A1 * 2/2016 Christie ..... A63B 21/00061 482/121
2016/0144217 A1 * 5/2016 Oltorik, Jr. ..... A63B 21/4043 482/130

* cited by examiner

EXERCISE BAR

CROSS REFERENCE TO RELATED APPLICATION

The present application relies on the disclosure of and claims priority to and the benefit of the filing date of U.S. patent application Ser. No. 14/951,386 filed Nov. 24, 2015, which relies on the disclosure of and claims priority to and the benefit of the filing date of U.S. Provisional Patent Application No. 62/083,604 filed Nov. 24, 2014. This application also relies on the disclosure of and claims priority to and the benefit of the filing date of U.S. patent application Ser. No. 16/695,055 filed Nov. 25, 2019. The disclosures of the above applications are hereby incorporated by reference herein in their entireties.

FIELD OF THE INVENTION

This disclosure relates generally to the field of exercise equipment. More particularly, the instant disclosure relates to a portable or stationary exercise device for personal fitness and strength training.

BACKGROUND OF THE INVENTION

Regular exercise is typically recommended as a way to improve or maintain health. Far too often, however, too great of an emphasis is placed on cardiovascular activities such as cycling, running, or team sports such as basketball. While cardiovascular activities are important to improving and sustaining personal health, so is strength training, or resistance training, which is frequently overlooked, especially in instances where strength training has been prescribed as part of a rehabilitation program. In fact, resistance training, most typically associated with increasing strength, is also known to aid in the prevention of injuries. To meet strength training and conditioning needs, consumers will often purchase expensive and elaborate gym equipment, which is bulky, takes up living space and is typically not portable, or commit to lengthy gym memberships, which sacrifices the convenience and comfort of a home workout. Taking into consideration the problems with the aforementioned options, portable exercise equipment has been developed to improve muscle mass and strength for home and on the go.

Current solutions have myriad shortcomings as well, including existing exercise equipment such as U.S. Pat. Nos. 4,057,246; 4,059,265; and 7,322,909 as well as U.S. Patent Application Publication No. 2012/0322633. For example, the elastic resistance bands rest outside the main apparatus creating a sloppy appearance and a dangerous whip should the handles slip. Additionally, the handles are flimsy and cumbersome and allow the resistance bands to come into uncomfortable contact with the user. In some existing devices, one or two flexible elements are not capable of providing the variety of resistance combinations desired by most users. Pulleys or other unnecessary small moving parts have been added to existing devices, which tend to complicate the apparatus, making it less reliable and harder to produce without any accompanying benefit. With some devices, the user is expected to step on the flexible element causing unnecessary wear and tear. Accordingly, a need exists for a strength training and conditioning device that is portable, compact, durable, and safe.

SUMMARY OF THE INVENTION

It is an object of embodiments disclosed herein to describe an exercise device for use in resistance training programs which is portable (e.g., for use in the home, while traveling, as part of a prescribed rehabilitation program for an injury or surgery), compact and durable (e.g., the elements of the device are stowed away within the device when the device is not being used), and is safe (e.g., proper use of the device is safe and will cause little to no risk of injury).

As will be demonstrated by certain embodiments disclosed herein, the exercise device can be used by gripping the bar member in the hands of the user and then standing on the securing member (e.g., handle) that is coupled to an end of the resistance members.

The embodiments disclosed are superior to current options found on the market because the handles of the current offerings are small, flimsy, and cause the elastic bands to come into contact with the user's body (especially arms, legs and back) during many exercises, which causes pain and discomfort.

In particular embodiments, the exercise device will have a plurality of resistance members offering different levels of resistance. Different resistance members can be engaged in different combinations to provide multiple levels of resistance for different exercises.

The resistance members may, in certain embodiments, be nested/stored inside the bar member when a resistance band is not in use. In these embodiments, it is envisioned that when the device is in a resting state, the resistance band members will be stored away inside the bar and not hanging out of the end or down from the device in any way. This provides a more portable design, making for a neater, cleaner apparatus, and a safer device as well. The resistance band members will naturally retract to the inside of the bar preventing them from whipping around if released unnecessarily during exercise. In certain embodiments, the resistance member will be coupled to the bar member or coupled to the inside walls of the bar member or other attachment members (e.g., anchors) contained on or within the bar member itself. Bands as used herein may also include, but are not limited to, any combination of resistance means, structures, or mechanisms, not just a rubber or polymer strip or band, but a rubber band anchored to a spring, for example. Bands may also include, but are not limited to, a solid circle cross section, a solid flat cross section, a weave of bands or other materials, a helix shape, etc.

The securing members (e.g., handles) of the device are also superior to currently available devices. In certain embodiments, the handle member will have a closed shape with three or more sides in which at least one side can be designed for gripping with the hands and at least one side can be designed to be stepped on with the feet. In other embodiments at least one side of the securing member can be adapted for coupling to ends of the resistance members, and alternatively or in addition, at least one side of the handle will be designed to couple, affix or hook to any stationary object. Still in other embodiments, at least one side of the securing member handle can be designed for an exercise partner to hold.

In one embodiment, the exercise device comprises: a bar member having a first end and a second end; at least one attachment member disposed on each of the first and second ends of the bar member; at least one resistance member coupled to each of the at least one attachment members; and at least one securing member coupled to the at least one resistance member. In preferred embodiments, the overall length of the exercise apparatus may be approximately 2 to 3 feet long, 3 to 4 feet long, 4 to 5 feet long, 5 to 6 feet long, 6 to 7 feet long, 7 to 8 feet long, 8 to 9 feet long, 9 to 10 feet long, and so on. The resistance bands may be approximately 1 foot, 2 feet, 3 feet, 4 feet, 5 feet, 6 feet, 7 feet, 8 feet, 9 feet, 10 feet, and so on, in length and extend from the first and second ends (outer ends) of the bar member to the center of the bar where they may be connected to the anchoring or attaching member. In a preferred embodiment, 2 foot long bands span half of the overall length of the exercise apparatus and may be flexible enough to extend to over four times their original length with maximum effort/tension applied by the user. This will ensure that the user can press the bar over his or her head and extend the arms fully as in FIG. 1B. The diameter of the apparatus should be comfortable to grip with the user's hands, particularly the gripping bar portion, and may be approximately 1 inch, 2 inches, 3 inches, 4 inches, 5 inches, 6 inches, and so on, in diameter in preferred embodiments. The sides of the handle in FIG. 4 (or securing member) may be approximately 1 inch, 2 inches, 3 inches, 4 inches, 5 inches, 6 inches, 7 inches, 8 inches, and so on, in preferred embodiments. In a preferred embodiment, the sides of the handle are approximately 5 inches in length. The sides of the shape of the handle (whether it be a triangle, square, pentagon, or other shape) should be large enough to accommodate the average male's hand and foot size.

Also provided is a portable exercise device comprising: a hollow bar operably configured for gripping with a user's hands; one or more resistance bands, each shorter than the hollow bar; multiple anchor members for securing the resistance bands to the bar; multiple attachable and detachable handles; wherein one end of each resistance band is coupled to an anchor member; wherein an opposing end of each resistance band is operably configured for attachment to a handle; such that each resistance band is contained completely within the bar during rest and is capable of extending outside the bar during use when attached to a handle.

Additional features and advantages are set forth in the detailed description which follows, and in part will be apparent from the description, or may be learned by the implementation of the principles of the embodiments disclosed and described below. The features and advantages may be realized and obtained by means of the instruments and combinations particularly pointed out in the appended claims.

BRIEF DESCRIPTION OF THE DRAWINGS

In order to describe the manner in which the above-recited and other advantages and features of the disclosed embodiments can be obtained, a more particular description will be provided by reference to specific embodiments which are illustrated in the appended drawings. The drawings depict only exemplary embodiments and are not, therefore, to be considered to be limiting of its scope. The embodiments will be described and explained with additional specificity and detail through the use of the accompanying drawings in which.

DETAILED DESCRIPTION OF VARIOUS EMBODIMENTS OF THE INVENTION

Figure 1A:
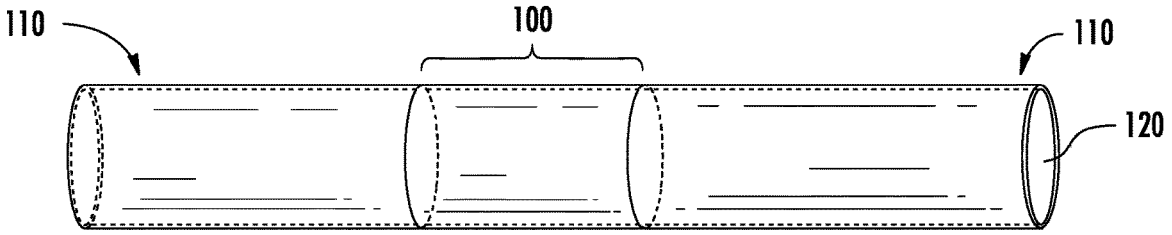
FIG. 1A is a schematic drawing of an exercise device as described herein.

The following description supplies specific details in order to provide a thorough understanding of various embodiments of the invention. Nevertheless, the skilled artisan would understand that embodiments of the exercise device and associated methods of making and using them can be implemented and used without employing these specific details. Indeed, exemplary embodiments and associated methods can be placed into practice by modifying the illustrated units and associated methods and can be used in conjunction with any other devices and techniques conventionally used in the industry.

Embodiments described herein comprise a bar member, at least one attachment member, at least one resistance member, and at least one securing member. In specific embodiments, provided is a portable exercise device comprising: a hollow bar operably configured for gripping with a user's hands; multiple resistance bands; multiple anchor members for securing the resistance bands to the bar; multiple attachable and detachable handles; wherein one end of each resistance band is coupled to an anchor member; wherein an opposing end of each resistance band is operably configured for attachment to a handle; such that each resistance band is contained at least partially within the bar during rest and is capable of extending outside the bar during use, especially when attached to a handle.

In embodiments, the hollow bar is adjustable.

The anchor members can be disposed within the hollow bar in embodiments.

The portable exercise device can comprise:

a first anchor member coupled to one end of a first resistance band such that an opposing end of the first resistance band is disposed at a first end of the hollow bar;

a second anchor member coupled to one end of a second resistance band such that an opposing end of the second resistance band is disposed at a second end of the hollow bar.

Still further, the anchor members can be integrally formed in the hollow bar, such as by way of one or more through hole(s) disposed in the hollow bar.

In embodiments, the anchor members can be disks or bars fused, glued, or soldered to an inside surface of the hollow bar. The elastic resistance member or members can then be attached in manners commonly known to those of ordinary skill in the mechanical arts to these anchor members. In other embodiments, the anchor member is the wall of the bar itself whereby the elastic members are affixed directly to the interior wall of the apparatus with no need for a separate anchor member.

Alternatively or in addition, the hollow bar or a housing attached to an end of the hollow or solid bar can comprise multiple passageways and outlets where only one resistance band is disposed in each passageway.

The bar member may be made of any acceptable material so long as the bar member is sufficiently strong to withstand the rigors of its intended use. The bar member in embodiments can be a solid bar, or partially solid and partially hollow. Non-limiting examples of acceptable materials for manufacture of the bar member include metals, alloys, plastics, polymers, wood, combinations of materials comprising metals, alloys, plastics, and/or woods, composite materials, etc. Further, the bar member may be any shape (e.g., cylindrical, polygonal, such as, triangular, square, hexagonal, octagonal, etc.) but is preferably hollow and of a shape and size that is comfortable for a user to grip the outside surface of the bar with their hands similar to a barbell or dumbbell.

The bar member may further be adjustable to accommodate the size and proportions of the individual user. In a particular embodiment, the length of the bar member is adjustable. The length of the bar member may be adjusted according to methods well-known in the mechanical arts. In an aspect, the bar member is comprised of a plurality of bar member elements (e.g., one or more bar member elements, such as two, three, four, five, six, seven, eight, nine, ten, and so on) which are adapted for telescopic adjustment. In another aspect, the bar member is comprised of a plurality of bar member elements (e.g., one or more bar member elements) which are adapted for assembly to a specified length (e.g., the one or more bar member elements can be coupled, each to the other, such as a male-female connection system, until a desired length is obtained). In yet another aspect, attachments, such as different bands or articles containing several bands, may be attached or detached to or from the bar.

Attachment members (e.g. anchors) may be any member sufficient for securing the at least one resistance member to the bar member. In particular embodiments, the at least one resistance member may be releasably coupled from the at least one attachment member. Non-limiting examples of attachment members suitable for coupling the resistance member to the first end and the second end of the bar member include adhesives, hook-and-loop attachment systems (Velcro®), tab-slot attachment systems, or any other fastener, such as tapes, screws, bolts, rivets, etc.

Further still, the attachment member (otherwise referred to as an anchor or anchor member), may be adapted to receive a plurality of resistance members (e.g., more than one resistance member, as in at least two resistance members, such as three resistance members, four resistance members, five resistance members, six resistance members, seven resistance members, eight resistance members, nine resistance members, ten resistance members, and so on) of various tensile strength and elasticity. In embodiments, the resistance members (also referred to as resistance bands) can be of the same tensile strength and elasticity, and the user can create different levels of resistance by grouping multiple bands together.

According to embodiments, attachment members are disposed on the first end and the second end of the bar member respectively. The at least one attachment member may be positioned (e.g., disposed, affixed, etc.) within the bar member cavity (e.g., the attachment member may be disposed on the inner walls of the bar member, the attachment member may comprise a hole in the inner walls of the bar member for a tab-slot attachment mechanism, etc.) or the at least one attachment member may be positioned on the outer surface of the bar member (i.e., external to the cavity). The attachment member or anchor member may be the bar itself with a through hole.

The at least one attachment member may be positioned within the cavity of the bar member for coupling to at least one resistance member. In one aspect, the attachment member may be in a fixed state (i.e., integrally formed) within the cavity of the bar member, such as by interference fit, adhesive, bonding, fusion, single piece construction, etc. In another aspect, the attachment member may be slidingly mounted within the cavity of the bar member for coupling to one or more one resistance members. In a particular aspect, the attachment member is slidingly mounted within the cavity of the bar member by coupling the attachment member to one or more resistance members which are further coupled to the bar member (e.g., resistance members are mounted on opposing sides of the attachment member). Such a configuration permits the attachment member to slide towards the distal end of the bar member when the resistance members are coupled to the attachment member and stretched (i.e., when the device is being used). The configuration not only affords additional layers of resistance training, it provides an automated retrieval and storage of the resistance members. In particular, when the device is no longer being used, the resilient members will relax causing the attachment member to slide towards the proximal end of the bar member retracting the one or more resistance members into the device. In embodiments, the resistance band can be connected with an attachment member (anchor member) and a spring.

According to the embodiments described herein, the at least one resistance member may be any material of appropriate tensile strength and elasticity to meet the requirements of the exercise device. The at least one resistance member can have any diameter or width and can be of any shape. When referring to a resistance band, the band can be planar or cylindrical. The resistance bands can be configured in other ways common in the mechanical arts such a in a helix shape (like a spring) or braided from two or more smaller bands. The resistance members may be constructed of rubber, latex, steel (e.g., the resistance member may be implemented by a cable or spring), woven steel, rope or other suitable materials, and can be releasably coupled to the attachment member to facilitate band interchange. The resistance members may be constructed of two or more materials fixed together that each impart desired characteristics to the resistance band such as tensile strength, durability, and elasticity.

In a particular aspect, the at least one resistance member is a resilient member, more particularly, the at least one resilient member is a coil, and even more particularly, the coil is a metal coil (e.g., a spring).

In another particular aspect, the at least one resistance member is made of an elastomeric material. In a particular aspect, the elastomeric material is a polyresinous material. In a more particular aspect, the elastomeric material is rubber (e.g., silicone rubber, plane rubber, etc.), latex, etc.

In particular embodiments, the exercise device may comprise a plurality of resistance members. In more particular aspects, the plurality of resistance members have a variety of tensile strengths, various diameters or widths, various elasticities, etc. to provide customizable amounts of resistance for the user.

In still another embodiment, the at least one resistance member may be stowed (i.e., nested) inside of the exercise device. In particular embodiments, the at least one resistance member may be releasably coupled from the at least one securing handle member to provide for storage of the at least one resistance member within a cavity of the exercise device. In another aspect, the at least one resistance member may have sufficient resiliency to retract into the exercise device when the user is finished with a strengthening program.

The securing member is any material capable of securing the at least one resistance member to an object such that the exercise device can be used. In a particular aspect, the securing member comprises at least one fastener for coupling the securing member to the at least one resistance member. The fastening member may be any object capable of receiving the at least one resistance member for coupling. (e.g., metal ring structure, a carabiner, etc.). In a particular aspect, the resistance member is adapted to be releasably coupled to at least one resistance member, meaning the handle can be attached and detached from the resistance band as desired. For example, when one or more of the multiple resistance bands is not being used for a particular exercise, the resistance bands can be stored in the hollow bar. When it is desired to use one or more of the resistance bands, the user can couple one end of the resistance band to a securing member (handle) to provide the bands in a position ready to be used. This way, resistance bands not being used are conveniently and safely stored out of the way of the user within the exercise bar.

In still other aspects, the exercise device may comprise a plurality of securing members, such as handles, (e.g., more than one securing member, as in at least two securing members, such as three securing members, four securing members, five securing members, six securing members, seven securing members, eight securing members, nine securing members, ten securing members, and so on). The plurality of securing members can be of various shapes and sizes to accommodate for a variety of exercises/strength training. In an aspect, the securing member is adapted for securing the exercise device to a body part of the user (e.g., the feet, legs, etc.). In another aspect, the securing member is adapted for securing the exercise device to a structure (e.g., a door, furniture, etc.). One handle can be used for each resistance band or multiple resistance bands can be attached to a single handle.

In aspects, the securing member is a non-fabric (e.g., a metal, wood, plastic, polymer, etc.) material. In other aspects, the securing member is a fabric material. In a more particular embodiment the securing member is a multi-ply fabric material. It is envisioned that in particular aspects, the multi-ply fabric will allow for a channel such that the at least one resistance member is able to pass through for coupling to attachment members as disclosed herein. In still another aspect, the securing member combines materials comprising fabric and non-fabric materials.

In still other aspects, the securing member is adjustable. In a particular aspect, the securing member is adjustable via mechanisms known in the mechanical arts, more particularly, the securing member is adjustable using hook-and-loop systems or other securement systems which provide adjustability appropriate for the demands of the user (e.g., carbiner-and-loop, etc.).

Figure 1B:
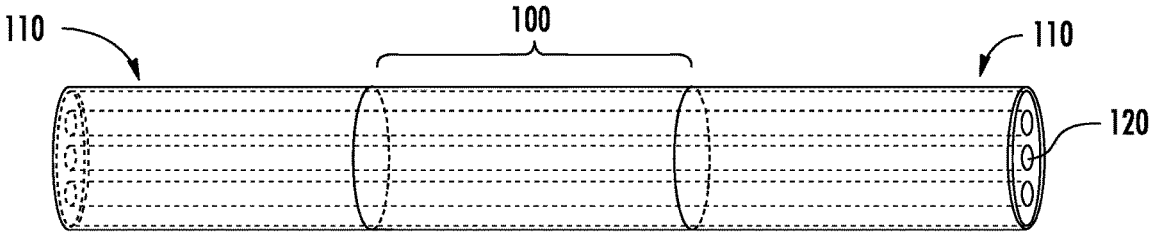
FIG. 1B is a schematic drawing of an exercise device as described herein.
Figure 1C:
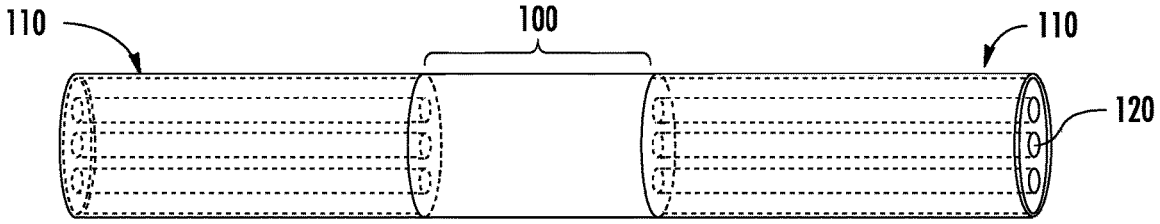
FIG. 1C is a schematic drawing of an exercise device as described herein.

As shown in FIGS. 1A-1C, the exercise device may comprise a first housing and a second housing 110 disposed on opposing ends of the bar member 100. In particular aspects, the first and second housings 110 are releasably coupled to the bar member 100 for enhanced portability or storage. The housings can comprise multiple cavities 120, each for retaining one or more resistance bands. One or more or all of the cavities (hollow passageways) 120 within the housings 110 can be aligned with the hollow portion of a hollow bar member 100. Alternatively or in addition, the hollow cavities 120 of the housings 110 may be disposed such that they are not aligned with the hollow portion of the hollow bar 100. In embodiments, the housings 110 with or without hollow cavities 120 may be attached to a solid bar member 100. Alternatively or in addition, the hollow bar 100 can comprise several cavities, each for retaining one or more resistance bands within the hollow bar member 100.

Embodiments including the first and second housings 110 provide the user with a strength training exercise that feels like the use of a conventional barbell. As shown in FIGS. 1A and 1B, the first and second housings 110 give the exercise device a look and feel familiar to men and women who include strength training in their work out regimens.

The first and second housings 110 can be made of any material capable of withstanding the rigors of a strength training program. In particular aspects, the first and second housings are made of a hard material (e.g., metals and metal alloys, such as steel aluminum, iron, etc.; plastics; polymers; etc.). The first and second housings 110 can provide additional weight to contribute to the training.

In particular embodiments, the first and second housings 110 have the additional ability to receive and store the one or more resistance members in the interior of the first and second housings respectively. As illustrated in FIG. 1A-1C, first and second housings 110 comprise at least one cavity 120 extending transversely through the first and second housings respectively. In a particular aspect, the at least one resistance member may pass through the cavity 120 in the first and second housings 110 for coupling to at least one attachment member (e.g., anchor member). The attachment member may be disposed on the bar member 100 or disposed within the first and second housings 110 respectively, or within a hollow bar 100 to which the first and second housings are attached or affixed. A handle member may be attached or affixed by a securing means to one or more resistance members.

FIGS. 2A-2I illustrate various mechanisms for securing the at least one resistance member 230 to the at least one attachment or anchor member.

Figure 2A:
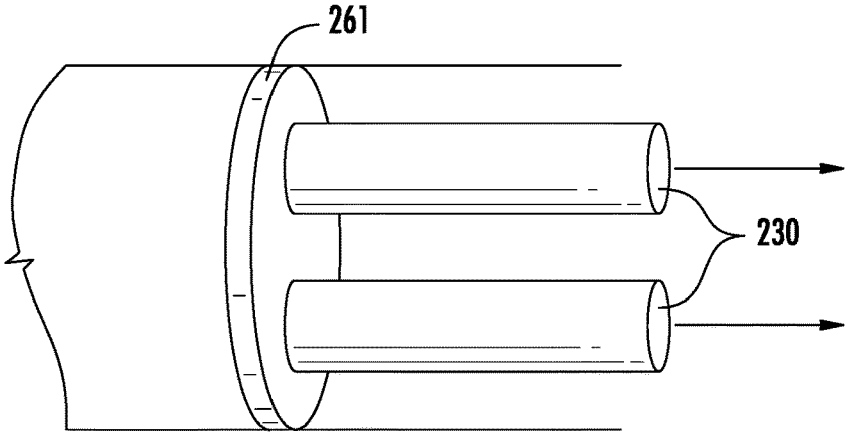
FIGS. 2A-2I are schematic drawings showing partial cut away views of a number of different couplings of a resistance member to attachment members according to embodiments described herein.

FIG. 2A illustrates a particular aspect of the exercise device. As shown in FIG. 2A, the attachment member (a disk-like structure) 261 can be disposed within the hollow exercise bar 100 or a cavity of a housing attached to the exercise bar 110 and the resistance band members 230 can be permanently fixed to the resistance member (e.g., anchor member and resistance band are fused/bonded together).

Figure 2B:
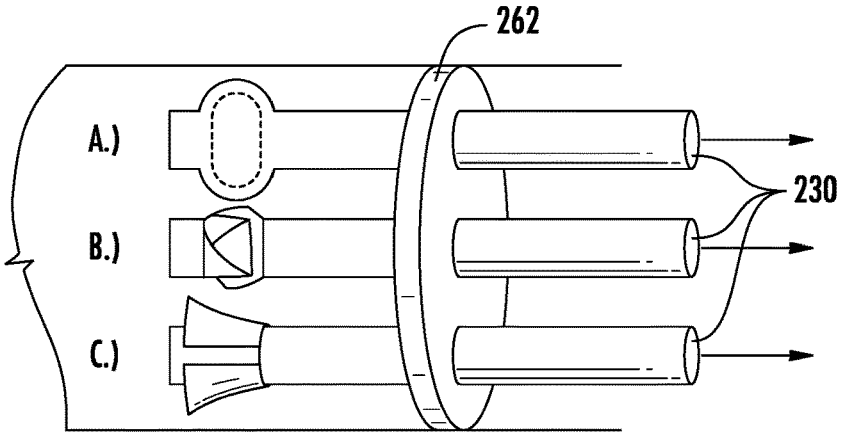

Other examples of affixing the resistance member 230 to the attachment member in a similar manner are found in FIGS. 2B-2E, such as loop attachments and using engagement between the resistance member and the attachment member. For example, FIG. 2B illustrates an aspect of the exercise device where the attachment member or anchor 262 is disposed within the hollow exercise bar 100 or a cavity of a housing attached to an exercise bar 110 and multiple resistance members 230 are passed through holes in the attachment member 262. The resistance bands 230 are affixed to the anchor members 262 by configuring one end of the resistance bands 230 with a structure that is larger than the hole of the anchor member 262 so that the end of the resistance band will be held by the anchor member 262 when the opposing end of the resistance bands is pulled. Such couplings include ball-stops and wedge stops, as illustrated in examples A.), B.), and C.) of FIG. 2B.

Figure 2C:
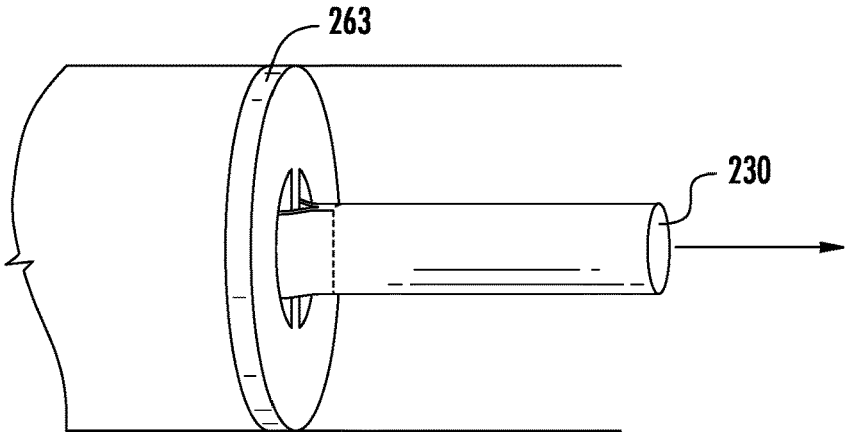
Figure 2D:
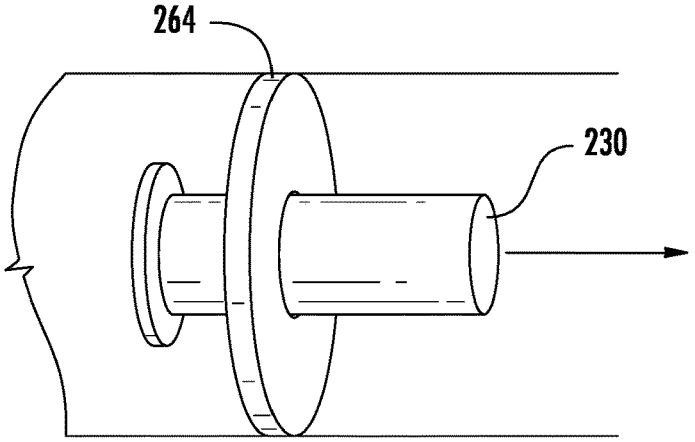
Figure 2E:
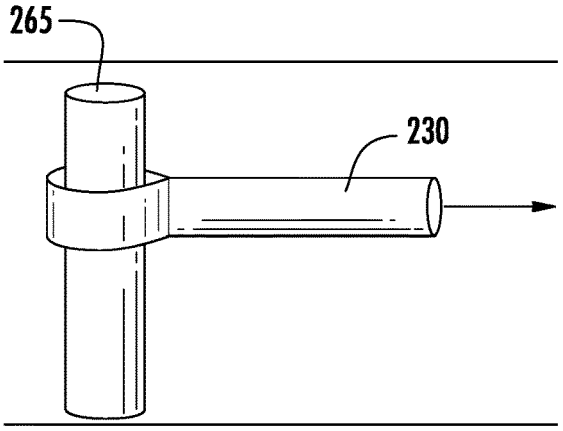

Further, for example, FIG. 2C illustrates another aspect where resistance members 230 are passed through holes in the attachment member 263 and anchored to the attachment member 263 by threading the resistance band 230 through the holes around a support on the anchor member 263 for securing the resistance band in place. Similar to FIG. 2B, FIG. 2D illustrates another aspect where the resistance bands 230 are affixed to the anchor member 264 by configuring one end of the resistance bands 230 with a structure that is larger than the hole of the anchor member 264 so that the end of the resistance band 230 will be held by the anchor member 264 when the opposing end of the resistance bands is pulled. FIG. 2E illustrates another aspect where resistance members 230 include a loop at the end of the resistance bands that encircles an anchor member 265 for securing the resistance bands in place.

Figure 2F:
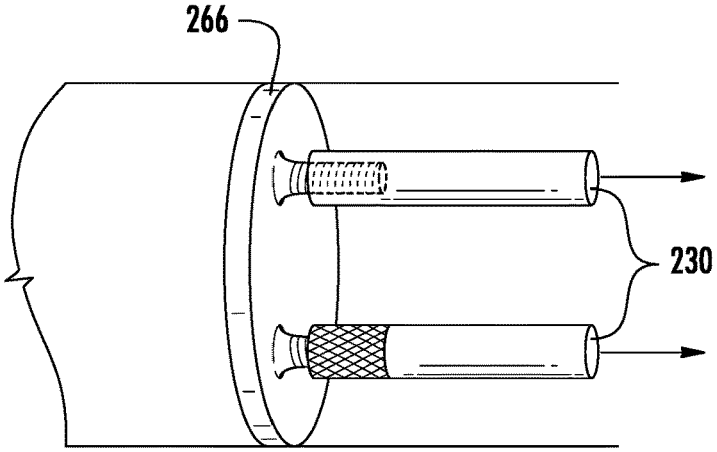

FIG. 2F shows an embodiment where the resistance band 230 is screwed and/or pressed onto the anchor member 266.

Figure 2G:
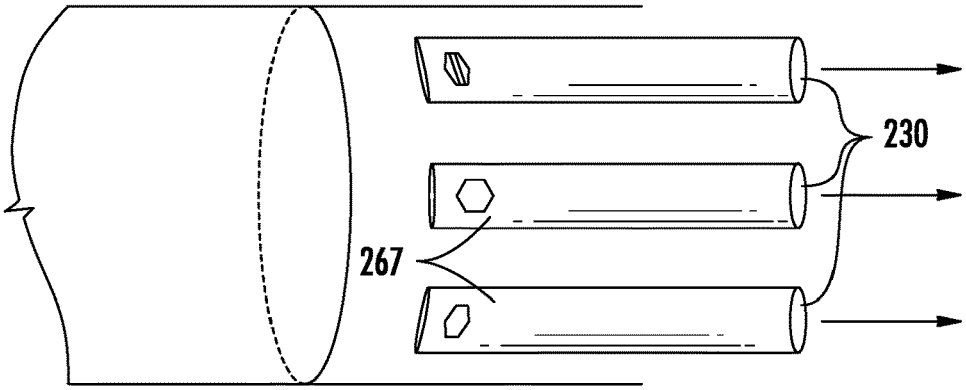
Figure 2H:
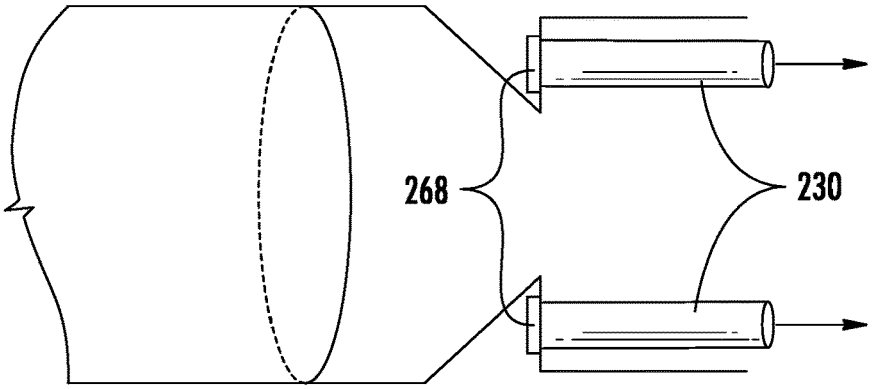
Figure 2I:
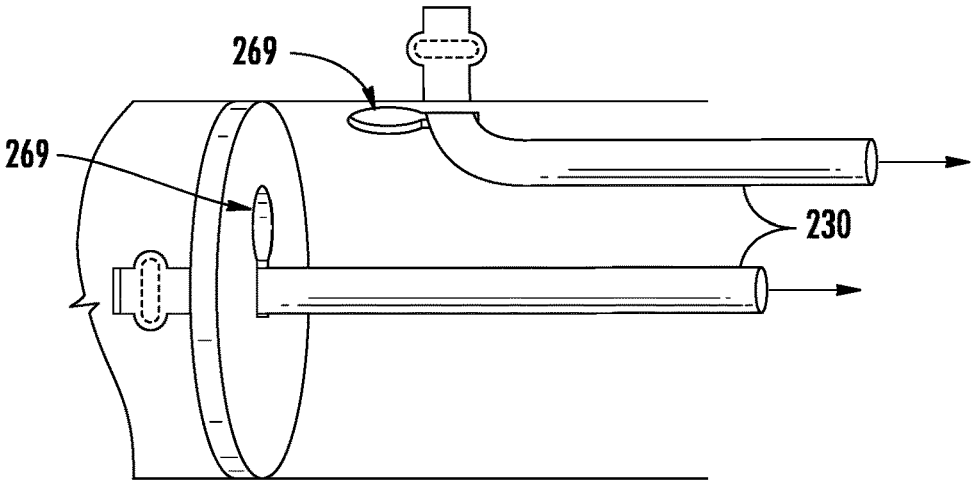

FIGS. 2G-I illustrate coupling of the resistance members 230 to the attachment member at a first end or second end of the bar member 100 or housing attached to the bar member 110. In embodiments, a screw, bolt, and/or rivet attachment system 267 can be used to couple the resistance bands 230 with an anchor member, the main structure of the bar 100, or the main structure of a housing attached to an exercise bar 110, without the need for an additional anchor member. In FIG. 2H, through holes are provided in the exercise bar 100, for example, and the resistance band 230 is passed through the hole and secured 268 or a screw or other attachment mechanism 267 (as illustrated in FIG. 2G) is used to attach the resistance band 230 to, for example, the bar 100. In another example, as in FIG. 2I, the through hole in the exercise bar 100 (or the housing attached to the exercise bar 110) can comprise a through hole 269 that is shaped to allow the resistance band 230 to pass through at one portion of the through hole 269, but then capture the resistance band 230 at another portion of the hole, that is one end of the through hole is larger than the other and shaped to retain the end of the resistance band 230 when pulled from the other end.

Figure 3A:
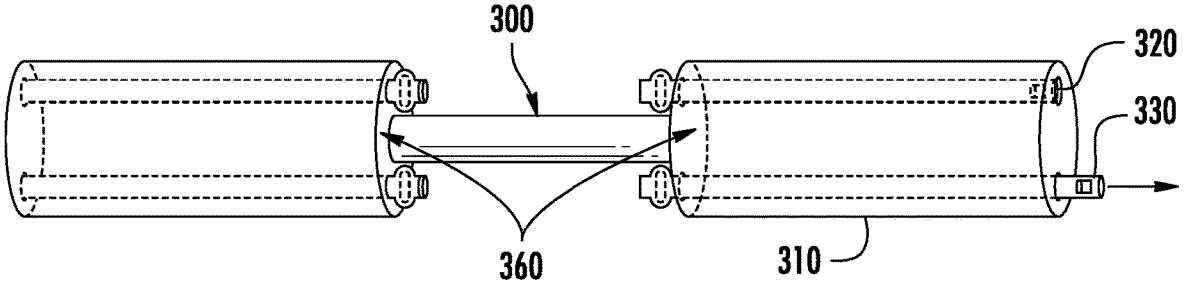
FIGS. 3A-3D are schematic drawings showing additional embodiments of the exercise device as described herein.
Figure 3B:
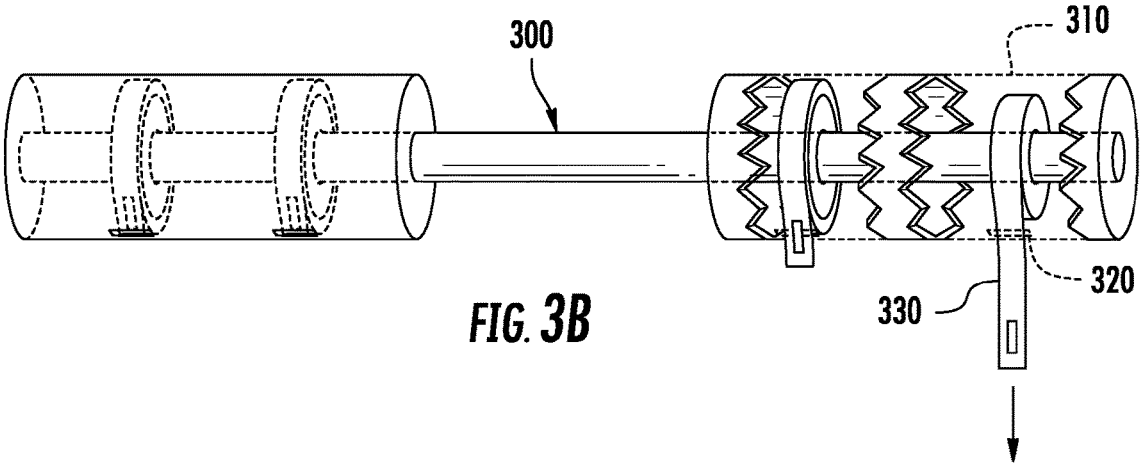
Figure 3C:
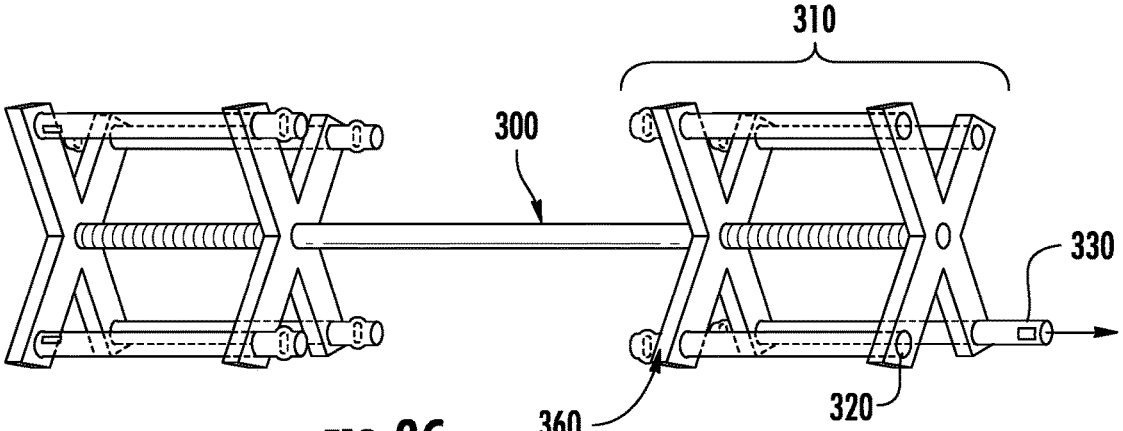

FIGS. 3A-3C illustrate additional embodiments of the exercise device. FIG. 3A shows the resistance band 330 passing through a housing 310 wherein the resistance band 330 is shaped to allow the resistance band to pass through at one portion of the housing 320, but then capture the resistance band at another portion of the housing (e.g., near or adjacent to the anchor member 360). An anchor member 360 may be used as a structure for capturing the resistance band at one end of the housing, or in embodiments the resistance band can be knotted at one end such that the opposing end of the resistance band 330 can be fed through the hollow cavity 320 of the housing 310 (or the hollow interior of the bar member 300) and the knot used to prevent the resistance band 330 from passing freely through the housing 310 (or bar member 300). The resistance band 330 can be configured such that one end of the resistance band is disposed outside the housing 310 at one end of the housing and the other end of the resistance band 330 is disposed entirely within the housing 310 at the other end of the housing, or only a small portion of the resistance band 330 extends beyond the housing at the other end. In preferred embodiments, the end of the resistance band configured for connection with a securing member (e.g., handle) extends beyond the housing 310 or end of the bar 300 no more than 10% of the length of the housing or bar. For example, in preferred embodiments, no more than 10% of the length of the resistance band 330 extends beyond the housing 310 or bar member 300. As shown in FIG. 3A, the bar member 300 between the housing members 310 (whether hollow or solid) is operably connected with housings 310 at each end of the bar 300 and one or more resistance bands 330 is disposed in a hollow cavity 320 of the housing such that one end of the resistance band is secured at one end of the housing in a manner to prevent the resistance band from passing through the housing and the other end of the resistance band is disposed within the housing or extends beyond the housing no more than 10% the length of the resistance band when the resistance band is in a relaxed state. The portion of the resistance band that extends beyond the housing can be no more than 5%, no more than 15%, no more than 20%, no more than 25%, no more than 30%, no more than 40%, or no more than 50% the length of the resistance band.

FIG. 3B shows a partial cut-away of another embodiment of the exercise device wherein the ends of the bar member (whether hollow or solid) 300 are disposed within a hollow housing 310 and one or more resistance bands 330 are secured to and wrapped around the bar member 300. During use, the resistance bands can be accessed through opening(s) 320 in the housing 310 through which the resistance bands 330 can be pulled into action.

FIG. 3C shows another embodiment of the exercise device where the housing 310 for the resistance bands 330 comprises at least two cross bar structures for securing or supporting ends of the resistance bands 330. Here, one end of the resistance band 330 is secured to one of the cross bar structures 360 while the other end of the resistance band 330 is supported by the other cross bar structure in a manner that renders the resistance band accessible for use. The resistance band at its accessible end can extend beyond the cross bar up to 10% of the length of the resistance band, or up to 5%, or up to 15%, or up to 20%, or up to 25%, or up to 30%, or up to 40%, or up to 50% of the length of the resistance band.

Figure 3D:
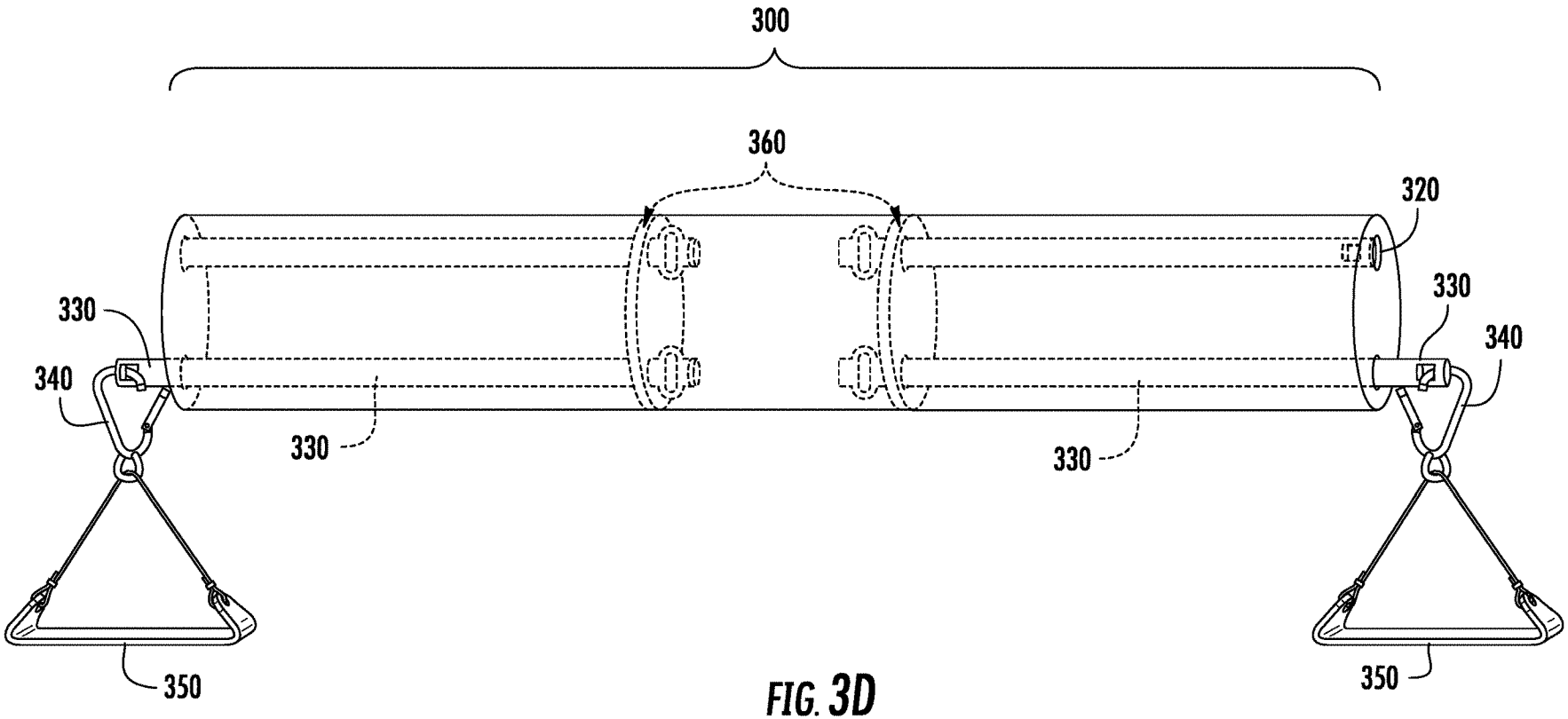

FIG. 3D shows yet another embodiment of the exercise device wherein the bar member 300 (without any housing on either end) is a hollow bar with anchor members 360 disposed within the hollow bar 300 for securing one or more resistance bands 330. The resistance bands 330 each have a length that is shorter than the length of the bar member 300. For instance, each resistance band may be 80% the length of the resistance bar, or 70% the length of the resistance bar, or 60% the length of the resistance bar, or 50% the length of the resistance bar, or 40% the length of the resistance bar, or 30% the length of the resistance bar, or 20% the length of the resistance bar, or 15% the length of the resistance bar, or 10% the length of the resistance bar, or 5% the length of the resistance bar, and so on. In a preferred embodiment, the resistance bands 330 are of a length such that when the exercise device is not in use, each resistance band is contained almost completely within the hollow bar member 300. Each resistance band 330 can be affixed to the anchor members 360 according to any attachment methods disclosed herein or to those known to people of ordinary skill in the mechanical arts. In particular embodiments, the resistance bands 330 are affixed to the anchor members 360 according to the attachments methods shown in FIGS. 2A-2I. In a preferred embodiment, the resistance bands 330 are affixed to the anchor member 360 by configuring one end of the resistance bands with a structure that is larger than the hole 320 of the anchor member 360 so that the ends of the resistance bands 330 will be held by the anchor member 360 when the opposing ends of the resistance bands are pulled. Such structures may include ball-stops and wedge stops, as illustrated in FIG. 2B, for example. As shown, the portable exercise device can further comprise securing mechanisms 340 and multiple attachable and detachable handles 350. In embodiments, one end of each resistance band 330 is in communication with an anchor member 360 disposed in the hollow bar 300, and the opposing end of the resistance band is secured 340 to a handle 350. During use, the handles 350 can be secured by the user's feet, while the user moves the resistance bar 300 with their hands. In this manner, resistance is created in the bands as the bands are stretched between the bar and the handles.

Figure 4:
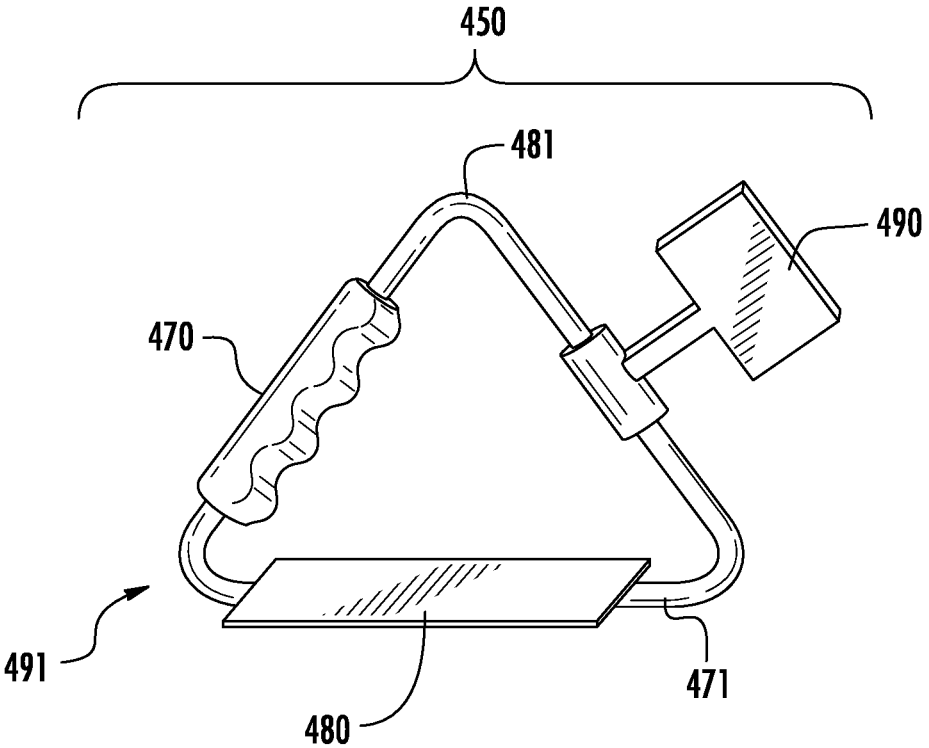
FIG. 4 is a schematic drawing of a handle for the exercise apparatus as described herein.

FIG. 4 illustrates an exemplary embodiment of a handle 450 that may be secured to one or more resistance bands. The handle 450, which may comprise three or more sides, includes on one side a grip adapted to be held by the user's hand 470, on another side a grip adapted to be secured by a user's foot 480, such as a planar surface for stepping on, and on another side a structure that is adapted for securing to a structure (e.g., a door, furniture, a hook or loop in a wall, etc.) 490. In one embodiment, at each angle of the handle, a means for securing the handle, such as a hole, would provide for securing of the handle to one or more resistance bands. For example, when the user is holding the handle with a hand 470, the handle would be connected to one or more resistance bands at position 471. When the user is using a foot to secure the handle in place 480, the handle would be connected to one or more resistance bands at position 481. And when the user is using a structure such as a door to secure the handle in place 490, the handle would be connected to one or more resistance bands at position 491.

In embodiments of the exercise device, it is not critical how the resistance bands are coupled to the anchor and any one or any combination of all of the attachment mechanisms may be used to couple them together.

The present invention has been described with reference to particular embodiments having various features. In light of the disclosure provided above, it will be apparent to those skilled in the art that various modifications and variations can be made in the practice of the present invention without departing from the scope or spirit of the invention. One skilled in the art will recognize that the disclosed features may be used singularly, in any combination, or omitted based on the requirements and specifications of a given application or design. When an embodiment refers to "comprising" certain features, it is to be understood that the embodiments can alternatively "consist of" or "consist essentially of" any one or more of the features. Other embodiments of the invention will be apparent to those skilled in the art from consideration of the specification and practice of the invention.

It is noted in particular that where a range of values is provided in this specification, each value between the upper and lower limits of that range is also specifically disclosed. The upper and lower limits of these smaller ranges may independently be included or excluded in the range as well. The singular forms "a," "an," and "the" include plural referents unless the context clearly dictates otherwise. It is intended that the specification and examples be considered as exemplary in nature and that variations that do not depart from the essence of the invention fall within the scope of the invention. Further, all of the references cited in this disclosure are each individually incorporated by reference herein in their entireties and as such are intended to provide an efficient way of supplementing the enabling disclosure of this invention as well as provide background detailing the level of ordinary skill in the art.

The invention claimed is:

1. An exercise device comprising:

a substantially rigid hollow tubular structure, wherein the substantial rigidity of the hollow tubular structure is capable of withstanding the rigors of a strength training program;

one or more cables running longitudinally through the substantially rigid hollow tubular structure; and an attachment or mechanism to select an amount of one or more resistive force or forces provided by the one or more cables;

wherein all or part of the one or more cables remains completely or partially within the substantially rigid hollow tubular structure when the exercise device is not in use, and wherein the one or more cables are capable of extending outside the substantially rigid hollow tubular structure during use;

wherein the substantially rigid hollow tubular structure is anchored at a first end of the substantially rigid hollow tubular structure to a stationary object, wherein an angle where the substantially rigid hollow tubular structure is anchored to the stationary object is adjustable, and wherein a second end of the substantially rigid hollow tubular structure comprises an opening for the one or more cables to extend outside the substantially rigid hollow tubular structure during use;

wherein the substantially rigid hollow tubular structure comprises one or more passageways;

wherein the one or more passageways are aligned in the longitudinal axis of the substantially rigid hollow tubular structure; and wherein pulling the one or more cables along the longitudinal axis out or away from the opening at the second end of the substantially rigid hollow tubular structure provides the one or more resistive force or forces to completely or partially resist the pulling of the one or more cable out or away from the opening.

2. The exercise device of claim 1, wherein the one or more cables contained partially or completely within the substantially rigid hollow tubular structure during rest are attachable and detachable.

* * * * *